US009960510B2

(12) United States Patent
Shiraishi et al.

(10) Patent No.: US 9,960,510 B2
(45) Date of Patent: May 1, 2018

(54) CONNECTOR

(71) Applicant: J.S.T. MFG. CO., LTD., Osaka-shi (JP)

(72) Inventors: Makoto Shiraishi, Miyoshi (JP); Hiroshi Yamada, Miyoshi (JP); Satoru Shindo, Yokohama (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days. days.

(21) Appl. No.: 15/596,462

(22) Filed: May 16, 2017

(65) Prior Publication Data

US 2017/0338575 A1 Nov. 23, 2017

(30) Foreign Application Priority Data

May 18, 2016 (JP) ..... 2016-099640
Apr. 11, 2017 (JP) ..... 2017-078168

(51) Int. Cl.
*H01R 13/627* (2006.01)
*H01R 12/71* (2011.01)
*H01R 12/70* (2011.01)
*H01R 31/00* (2006.01)

(52) U.S. Cl.
CPC ..... *H01R 12/716* (2013.01); *H01R 12/7082* (2013.01); *H01R 31/00* (2013.01)

(58) Field of Classification Search
CPC ... H01R 31/00; H01R 12/7082; H01R 12/716
USPC ..... 439/533, 341, 376
See application file for complete search history.

(56) References Cited

U.S. PATENT DOCUMENTS 3,617,985 A * 11/1971 Kehl ..... H01R 23/10 439/341
4,941,841 A * 7/1990 Darden ..... G06F 1/184 361/679.39
5,083,934 A * 1/1992 Kawaguchi ..... H01R 9/053 439/341
6,053,759 A * 4/2000 Kunert ..... H01R 13/62933 439/376
6,364,682 B1 * 4/2002 Cappe ..... H01R 23/667 439/341
6,503,094 B1 * 1/2003 Okabe ..... B60J 3/0221 439/376

(Continued)

FOREIGN PATENT DOCUMENTS

JP 2015-116993 A1 6/2015

*Primary Examiner* — Abdullah Riyami
*Assistant Examiner* — Nelson R Burgos-Guntin
(74) *Attorney, Agent, or Firm* — Kratz, Quintos & Hanson, LLP

(57) ABSTRACT

A male connector includes a housing fixed to a base, a holding unit supported in such a manner as to enable displacement with respect to the housing; and an elastically deformable male terminal held by the holding unit. The housing is able to maintain the holding unit in a stationary state with the terminal undeformed and apart from the conductive film, while the holding unit is in the temporal locking position with the housing fixed to the base. The housing is able to maintain the holding unit in a stationary state with the terminal elastically deformed and contacting the conductive film, while the holding unit is in the non-temporal locking position with the housing fixed to the base.

12 Claims, 14 Drawing Sheets

(56) References Cited

U.S. PATENT DOCUMENTS

| | | | | |
|---|---|---|---|---|
| 6,549,416 | B2 * | 4/2003 | Sterner | G06F 1/1632<br>361/679.43 |
| 7,059,884 | B2 * | 6/2006 | Hisaeda | H01R 13/20<br>439/329 |
| 7,156,678 | B2 * | 1/2007 | Feldman | H01R 4/024<br>439/326 |
| 7,261,580 | B1 * | 8/2007 | Secora | H01R 12/83<br>439/341 |
| 7,654,829 | B1 * | 2/2010 | Chuang | H01R 12/79<br>439/67 |
| 7,862,360 | B2 * | 1/2011 | Wang | H01Q 1/1271<br>439/326 |
| 7,918,682 | B2 * | 4/2011 | Hirai | H01Q 1/1278<br>439/374 |
| 8,043,114 | B2 * | 10/2011 | Kaneko | H01R 13/65802<br>439/468 |
| 8,939,794 | B2 * | 1/2015 | Mason | H01R 9/0515<br>439/581 |
| 9,306,325 | B2 * | 4/2016 | Cheng | H01R 13/6271 |
| 2011/0306229 | A1 * | 12/2011 | Katsui | H01R 13/629<br>439/345 |

* cited by examiner

CONNECTOR

TECHNICAL FIELD

The present invention relates to a connector used for electrical connection of a conductive film formed on glass for use in a vehicle for example.

BACKGROUND ART

As a known connector terminal structure of a defogger wire of a resin-made window plate used in a rear window of a vehicle, there is one in which a connector terminal is inserted into a terminal holder integrally formed with a resin-made window plate, thereby electrically connecting a defogger wire with a lead wire via the connector terminal, as is suggested in a Japanese Laid-open Patent Application, publication No. 2015-116993.

SUMMARY OF INVENTION

However, such a connector terminal structure described in the above publication is not applicable to a window frame other than those made of a resin, because the connector terminal is inserted into the terminal holder integrally formed with the resin-made window plate.

In view of the above problem, an object of the present invention is to provide a connector which allows electrical connection of conductive films on bases of various materials to a terminal.

A connector related to the present invention is a connector for use in electrically connecting a conductive film formed on a base to a counterpart terminal held by a counterpart connector, including: a housing fixed on the base; a holding unit displaceably supported with respect to the housing; and an elastically deformable terminal held by the holding unit, wherein the holding unit has a first lock section and a second lock section, the housing has a third lock section and a fourth lock section, and the holding unit displaces with respect to the housing so as to selectively take a temporal locking position where the first lock section and the third lock section are engaged with each other, and a non-temporal locking position in which the second lock section and the fourth lock section are engaged with each other. The housing is able to maintain the holding unit in a stationary state with the terminal undeformed and apart from the conductive film, while the holding unit is in the temporal locking position with the housing fixed to the base. The housing is able to maintain the holding unit in a stationary state with the terminal elastically deformed and contacting the conductive film, while the holding unit is in the non-temporal locking position with the housing fixed to the base. The terminal is able to contact the counterpart terminal, by having the housing fit together with the counterpart connector, while the holding unit is in the non-temporal locking position.

The present invention allows the housing to be fixed on the base. Therefore, it is possible to achieve electrical connection of a conductive film formed on abase of any of various materials, such as a glass-made member or a resin-made member, with a counterpart terminal. Further, lead-free connection is possible by adopting means other than soldering for fixing the housing to the base; e.g., use of an adhesive or a screw. Since the terminal is not in contact with the conductive film while it is in the temporal locking position, the connector will be free of the reaction force caused by the terminal contacting the conductive film while being elastically deformed. Therefore, a stress will not act on the connector, when the housing is fixed to the base by an adhesive or a screw, while the holding unit is in the temporal locking position. Further, the terminal contacts the counterpart terminal, thereby electrically connecting the conductive film with the counterpart terminal, through a relatively simple work of fitting the housing together with the counterpart connector, while displacing the holding unit from the temporal locking position to the non-temporal locking position.

Further, the holding unit may supported rotatably with respect to the housing. This way, the holding unit is easily displaced from the temporal locking position to the non-temporal locking position simply by rotation.

In this regard, it is preferable that the housing has a pair of side walls respectively having fitting holes on their inner side surfaces, and that the holding unit has a pair of shaft portions which fit in the fitting holes, respectively. This realizes a simple structure for supporting the holding unit rotatably with respect to the housing.

In the above case, it is further preferable that the housing has, as the third lock section, recesses on the circumferences of the fitting holes, which are sunk radially outward of the fitting holes; that the holding unit has, as the first lock section, protrusions protruding from the outer circumferential surfaces of the shaft portions, in a radially outward direction of the shaft portions; and that each of the protrusions of the holding unit is locked in corresponding one of the recesses of the housing, while the holding unit is in the temporal locking position. This realizes a simple structure whereby the holding unit is maintained in a stationary state in the temporal locking position.

Further, the housing may have an accommodation unit having an opening, in which the counterpart connector is inserted. The direction of the opening which is the direction of inserting the counterpart connector into the accommodation unit may be perpendicular to the rotation axis of the holding unit and parallel to a mounting surface of the housing with respect to the base. This facilitates a user to grasp the insertion direction of the counterpart connector to the housing, thereby improving the working efficiency.

The connector of the present invention preferably includes one or more metal-made reinforcement members which are attached to the housing; and each of the reinforcement members preferably has a portion facing the conductive film, while the housing is fixed to the base. This allows use of an adhesive for adhering the metal-made conductive film and the metal-made reinforcement member. When compared with a case of adhering a metal member with a resin member, this more securely fixes the housing to the base. Further, since there are wider variety of adhesives usable, as compared to the case of adhering a metal member with a resin member, it is possible to use a cost-efficient adhesive that provides a strong adhesion.

In the above case, it is preferable that two of the reinforcement members are disposed in positions to sandwich the terminal, while the holding unit is in the non-temporal locking position. This fixes housing more reliably to the base.

The terminal may have a press-fit portion which is press-fit into the holding unit, and the terminal may be held by the holding unit at the press-fit portion. This facilitates fixing of the terminal to the holding unit.

The holding unit preferably includes a cover member extended along the terminal, which covers a side of the terminal opposite to the side facing the base, while the holding unit is in the non-temporal locking position. This enables prevention of the terminal from contacting an exterior member, while the holding unit is in the non-temporal locking position. Further, the above structure keeps the terminal away from dusts.

The terminal preferably includes: a bent area bent in a substantially U-shape; a first area extended from one end of the bent area, which has a first contact point that contacts the counterpart terminal; and one or more second areas each extended from the other end of the bent area so that its position with respect to the first area changes by elastic deformation of the terminal, the one or more second areas each having a second contact point that contacts the conductive film. This makes the structure of the terminal simple.

The terminal is preferably provided with a plurality of the second areas whose respective positions with respect to the first area change independently of the one another by elastic deformation of the terminal. This improves the contact reliability of the terminal with respect to the conductive film.

The terminal may, through elastic deformation, contact the conductive film formed on the base made of glass, while the holding unit is in the non-temporal locking position. This way, the connector of the present invention is applicable to cases where the base is the glass for use in a vehicle, for example.

DESCRIPTION OF EMBODIMENTS

The following describes an embodiment of the present invention with reference to attached drawings.

Figure 1A:
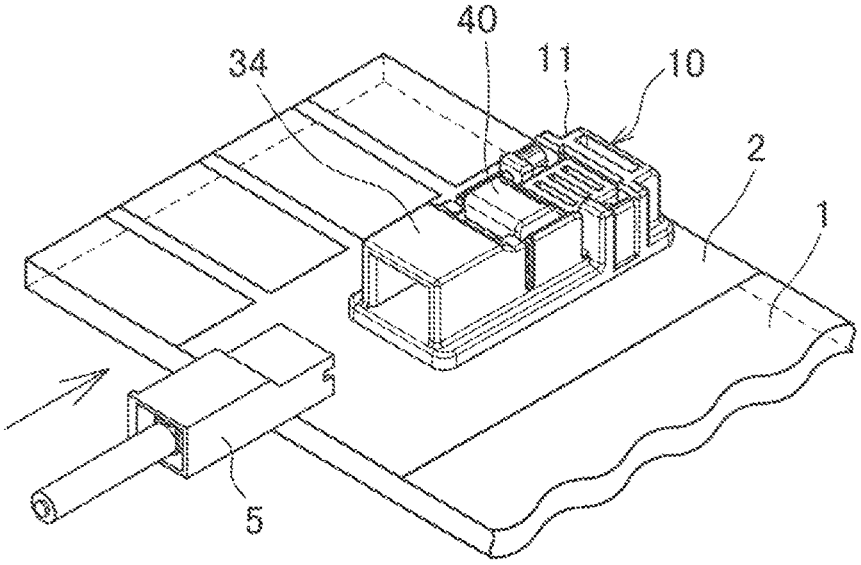
FIG. 1A is a perspective view of an embodiment of the present invention, showing a state before a female connector is inserted into a male connector.
Figure 1B:
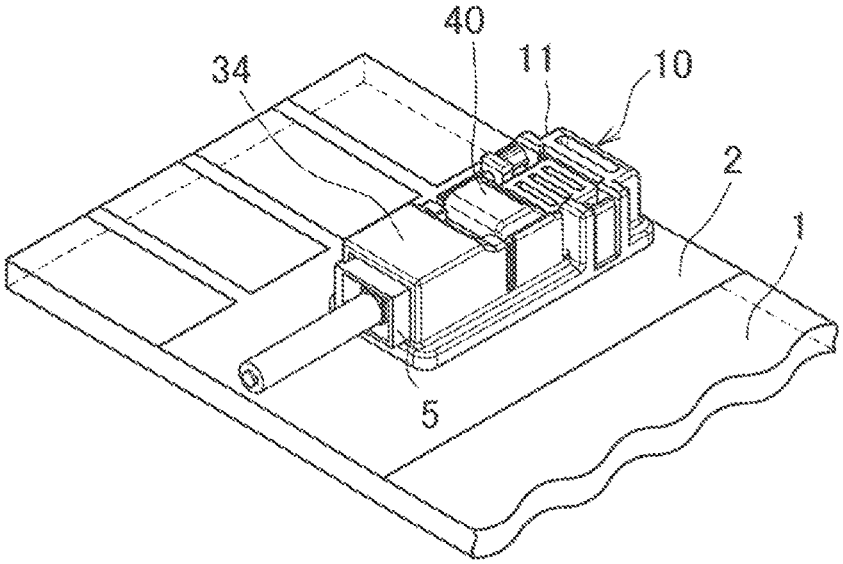
FIG. 1B is a perspective view of the embodiment of the present invention, showing the female connector inserted into the male connector.
Figure 15:
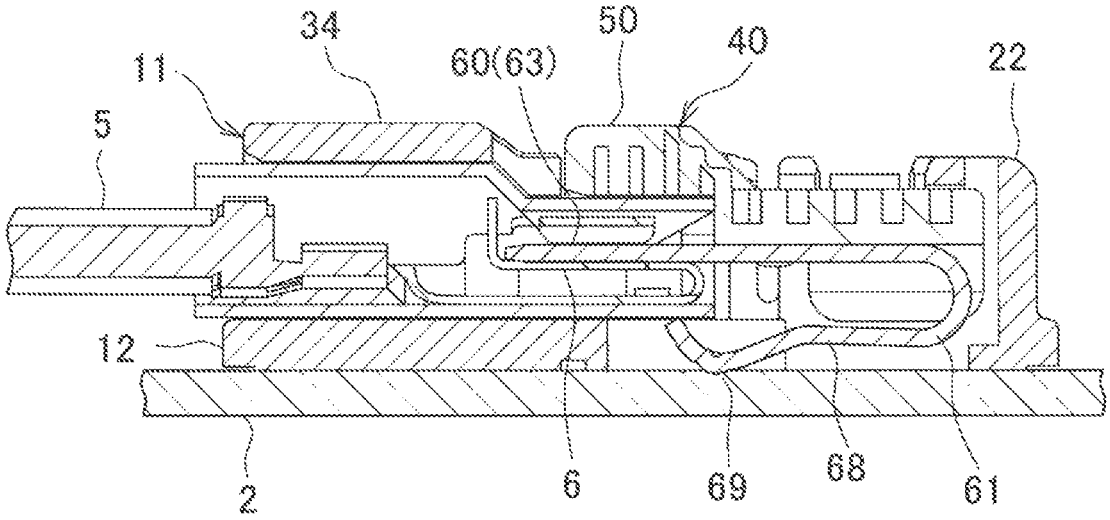
FIG. 15 is a cross sectional view of the female connector inserted into the male connector.

As shown in FIG. 1A and FIG. 1B, a male connector 10 of the present embodiment is used for electrically connecting a conductive film 2 formed on a base 1 which is a glass-made back window for a vehicle, with a counterpart terminal (female terminal) 6 (see FIG. 15) held by a female connector 5 which is a counterpart connector. The conductive film 2 is attached to a surface of the base 1 as a defogger wire.

Figure 2:
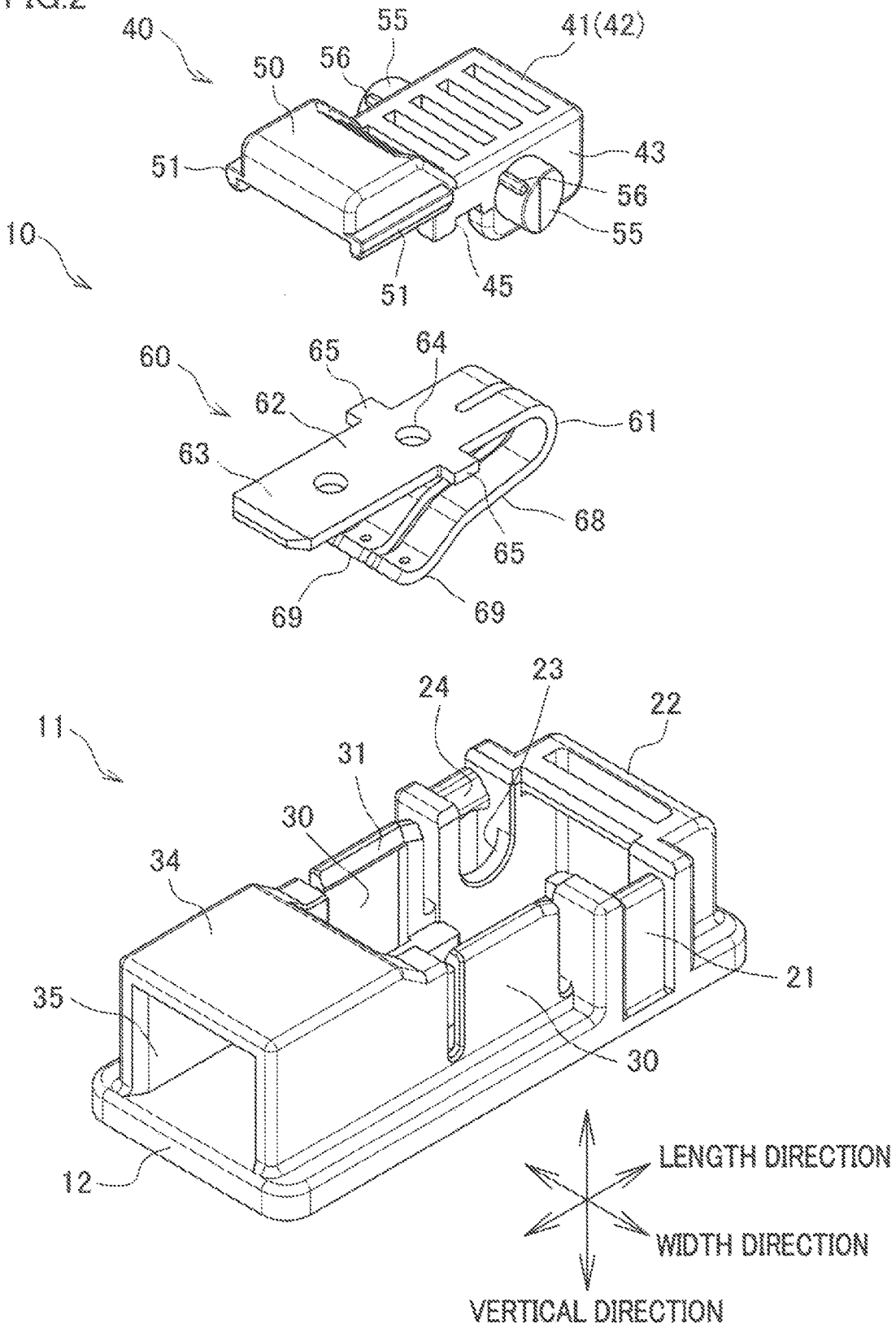
FIG. 2 is an exploded perspective view of the male connector shown in FIG. 1, viewed from the above.

As shown in FIG. 2, the male connector 10 includes a resin-made housing 11 fixed to the base 1, a holding unit 40 supported in such a manner as to enable displacement with respect to the housing 11; and an elastically deformable male terminal 60 held by the holding unit 40.

The housing 11 has a rectangular bottom plate 12 extended in a length direction, a pair of first side walls 21 provided to one end portion of the bottom plate 12, a pair of second side walls 30 arranged next to the first side walls 21, and an accommodation unit 34 provided on the other end portion on the bottom plate 12. The first side walls 21, the second side walls 30, and the accommodation unit 34 are arranged in this order in the length direction of the bottom plate 12.

Figure 3:
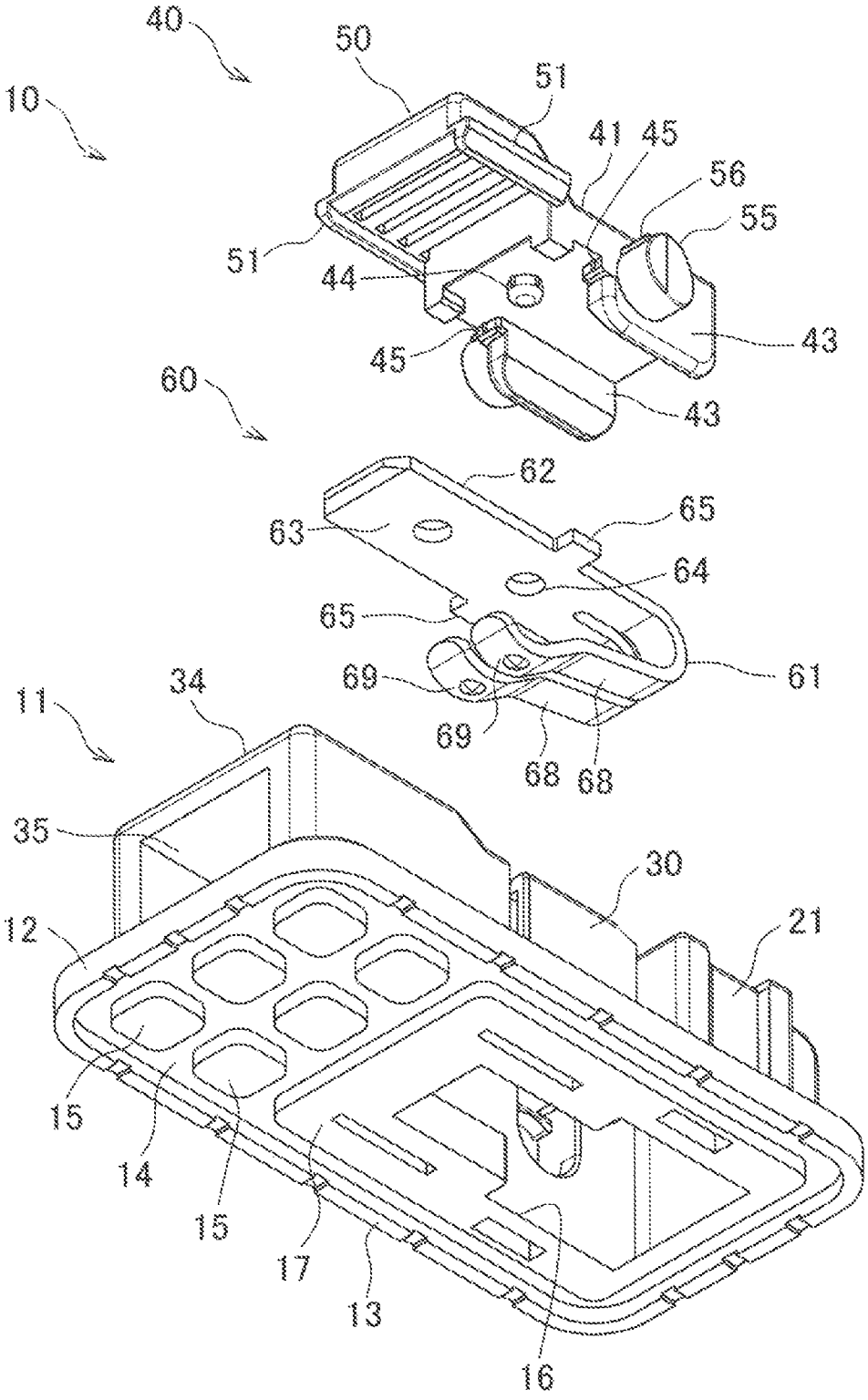
FIG. 3 is an exploded perspective view of the male connector shown in FIG. 1, viewed from the bottom.

As shown in FIG. 3, on the back surface of the bottom plate 12 is formed a back-side recess 14 which is sunk upward with respect to the peripheral edge portion 13 of the bottom plate 12. To this back-side recess 14 is applied an adhesive for fixing the housing 11 to the base 1. On the back-side recess 14 are provided back-side protrusions 15 protruding downward from the surface of the back-side recess 14, a through hole 16 in a rectangular shape when viewed from the front, which penetrates the bottom plate 12 in a thickness direction, and an anti-inflow protrusion 17 formed on whole circumference of the edge of the through hole 16. The adhesive applied to the back-side recess 14 is prevented from flowing out outward of the bottom plate 12 by the peripheral edge portion 13, and is prevented from flowing into the through hole 16 by the anti-inflow protrusion 17.

A pair of first side walls 21 supports the holding unit 40 rotatably with respect to the housing 11, as hereinafter described. The first side walls 21 are each rectangular extended vertically upward from the edge portion of the length side of the bottom plate 12, and face each other in width directions perpendicular to the length direction. The first side walls 21 are each arranged between an upright wall 22 extended up from the edge portion of a short side of the bottom plate 12 and the second side walls 30. Further, the first side walls 21 each has a fitting hole 23 provided on its inner side surface, and a first protrusion 24 protruding inward from the upper end portion of the inner side surface. In the periphery of the fitting hole 23 is formed a third lock section 25 which is a recess sunk radially outward of the fitting hole 23 (see FIG. 11).

The second side walls 30 are each rectangular extended vertically upward from the edge portion of the length side of the bottom plate 12, and face each other in the width directions. The second side walls 30 are arranged between the first side walls 21 and the accommodation unit 34, and are spaced from the first side walls 21 and the accommodation unit 34. Each of the second side walls 30 has a fourth lock section 31 protruding inward from the upper end portion of the inner side surface.

The accommodation unit 34 has a box-shape with openings 35 on both end portions relative to the length direction of the bottom plate 12, and accommodates the female connector 5 inserted. The direction of the openings 35 which is the direction of inserting the female connector 5 into the accommodation unit 34 is perpendicular to the rotation axis line L of the later-described holding unit 40, and is parallel to the mounting surface of the housing 11 to the base 1 (the back surface of the bottom plate 12).

The holding unit 40 is supported rotatably with respect to the housing 11, and selectively takes a temporal locking position and a non-temporal locking position, which are described later. The holding unit 40 has a main body 41 configured to hold a male terminal 60, a cover member 50 extended in the length direction from the main body 41, and a pair of shaft portions 55 formed on side faces of the main body 41.

Figure 4:
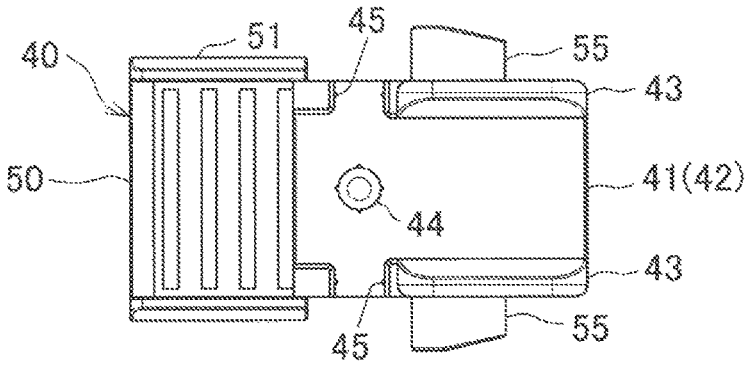
FIG. 4 is a bottom view of a holding unit.
Figure 5:
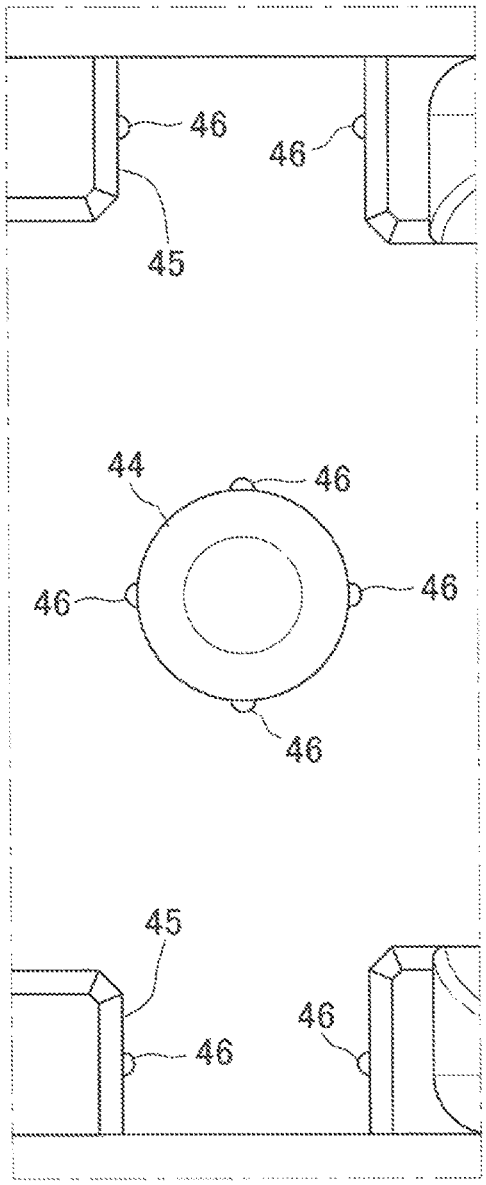
FIG. 5 is a partially enlarged bottom view of a positioning protrusion on the holding unit and a main body recess.

The main body 41 has a U-shaped cross section, including a base portion 42 of a thick plate form and a hanging walls 43 hanging from the base portion 42. On the back surface of the base portion 42 is provided a positioning protrusion 44 for positioning the male terminal 60. At the lower edge of each of the hanging walls 43 is provided a main body recess 45 which is sunk upward. As shown in FIG. 4 and FIG. 5, on the side face of the positioning protrusion 44 and the side faces defining the main body recesses 45 have crush ribs 46.

The cover member 50 is in a rectangular parallelepiped shape with corners chamfered, and is levelled higher than the main body 41. At the lower edge portions of the side faces of the cover member 50, there is provided a pair of second lock sections 51 extended in the length direction of the holding unit 40.

The shaft portions 55 each has a cylindrical shape which extends outwardly in a horizontal direction from the side faces of the main body 41. On the outer circumferential surface of each of the shaft portions 55 is formed a first lock section 56 which is a protrusion protruding radially outward of the shaft portion 55. The first lock section 56 extends in the axial direction of the shaft portion 55.

The male terminal 60 is made of a metal, and includes: a bent area 61 which is bent substantially in a U-shape, a first area 62 extended in the length direction from one end of the bent area 61, and two second areas 68 each of which extends obliquely downward below the first area 62, from the other end of the bent area 61.

The first area 62, in the form of a plate having a rectangular shape, includes: a first contact point 63 formed at a leading end portion, a positioning hole 64 formed on a side close to the bent area 61, and press-fit protrusions 65 each of which extends in a horizontal direction from a side face. The inner circumference wall defining the positioning hole 64 and the press-fit protrusions 65 structure the press-fit portion of the male terminal 60.

The two second areas 68 are in an identical shape, and extends downward, tilted with respect to the first area 62. Further, the second areas 68 each has on its leading end portion, a second contact point 69. The male terminal 60 elastically deforms to change the position of the two second areas 68 with respect to the first area 62. To be more specific, with the elastic deformation of the male terminal 60, the second contact points 69 displace in the up-down direction, and the distances between the second contact points 69 from the first area 62 change. Further, when the male terminal 60 elastically deforms, the positions of the two second areas 68 with respect to the first area 62 change independently of one another.

Next, the following describes the steps of assembling the male connector 10.

Figure 6:
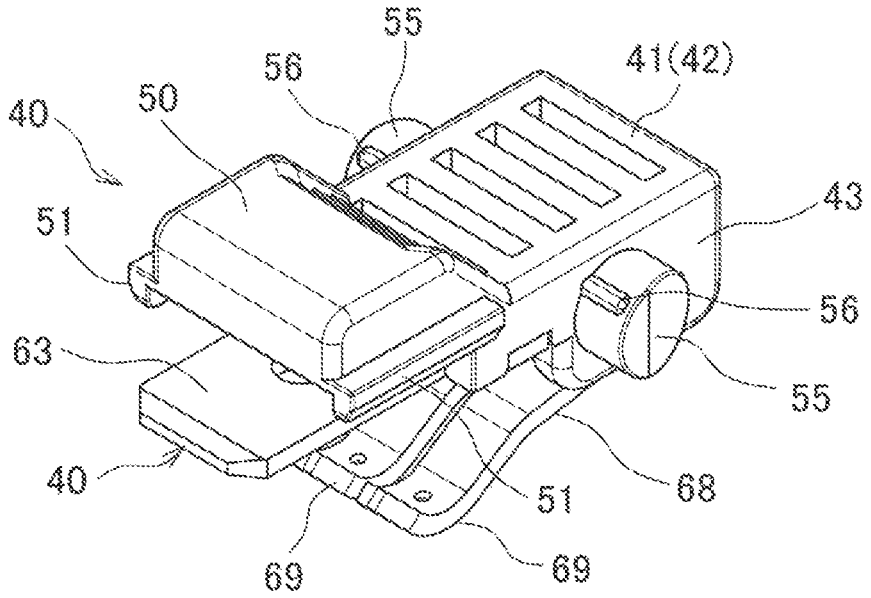
FIG. 6 is a top perspective view of a state in which a male terminal is assembled to the holding unit.
Figure 7:
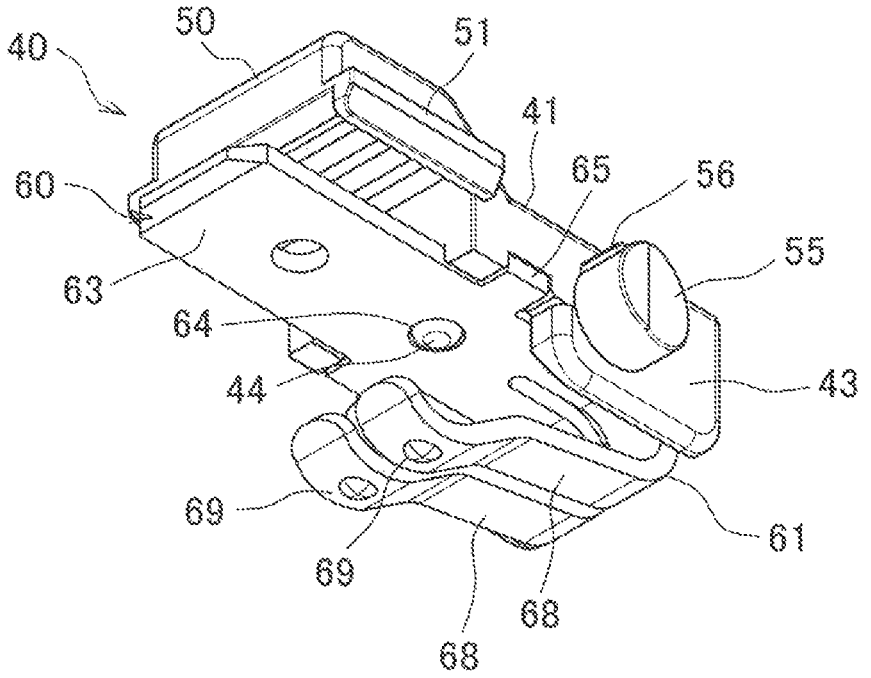
FIG. 7 is a bottom perspective view of a state in which a male terminal is assembled to the holding unit.

First, as shown in FIG. 6 and FIG. 7, the male terminal 60 is press fit into and fixed to the holding unit 40. Specifically, the positioning protrusion 44 of the holding unit 40 is press-fit into the positioning hole 64 of the male terminal 60, and the press-fit protrusions 65 of the male terminal 60 are press-fit into the main body recesses 45 of the holding unit 40. At this time, the inner circumference wall defining the positioning hole 64 collapses the crush ribs 46 around the positioning protrusion 44, while the press-fit protrusions 65 collapses the crush ribs 46 nearby the main body recesses 45, thereby realizing press fitting. With the male terminal 60 assembled with the holding unit 40, the male terminal 60 is held by the holding unit 40 at the press-fit portion.

Figure 8:
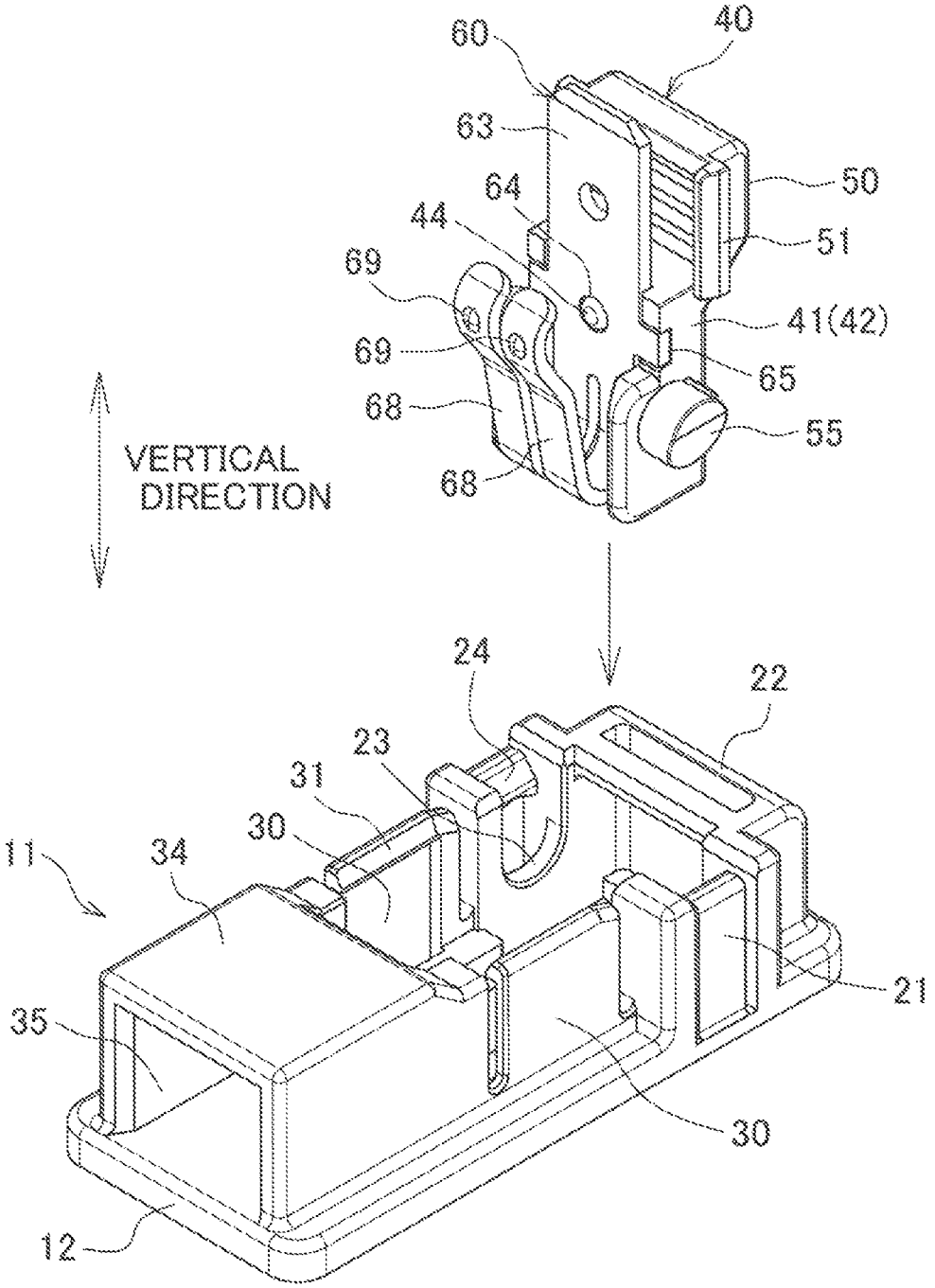
FIG. 8 is a perspective view showing a state before the holding unit is inserted into the housing.
Figure 9:
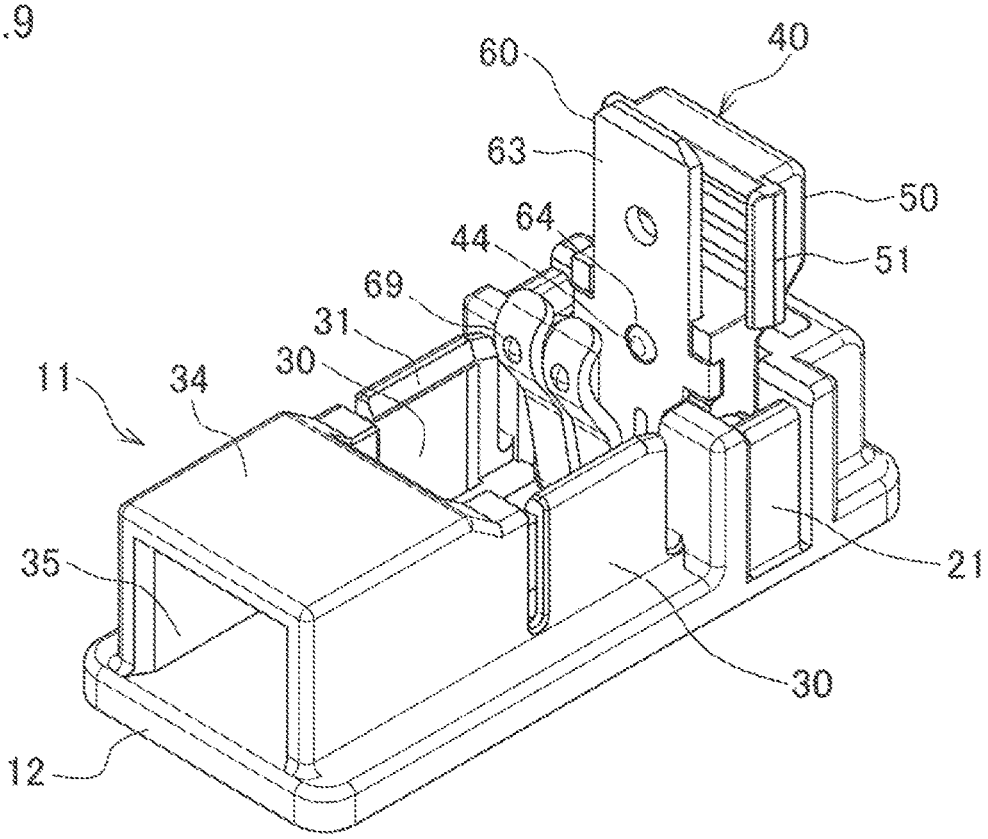
FIG. 9 is a perspective view of the holding unit inserted into the housing.
Figure 11:
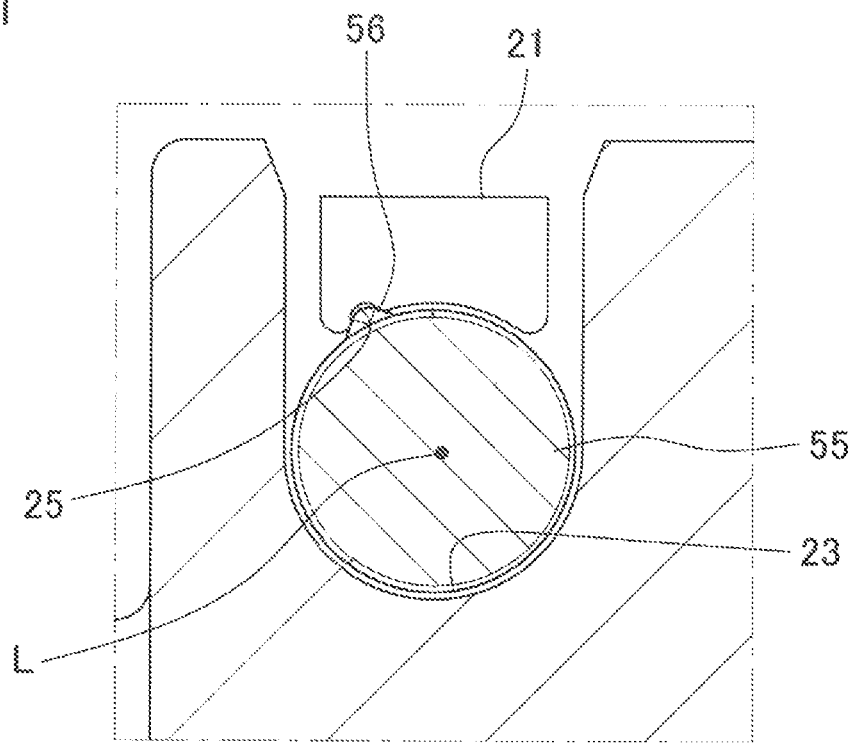
FIG. 11 is a partial enlarged cross sectional view of the periphery of the shaft portion in the temporary locked state.
Figure 12:
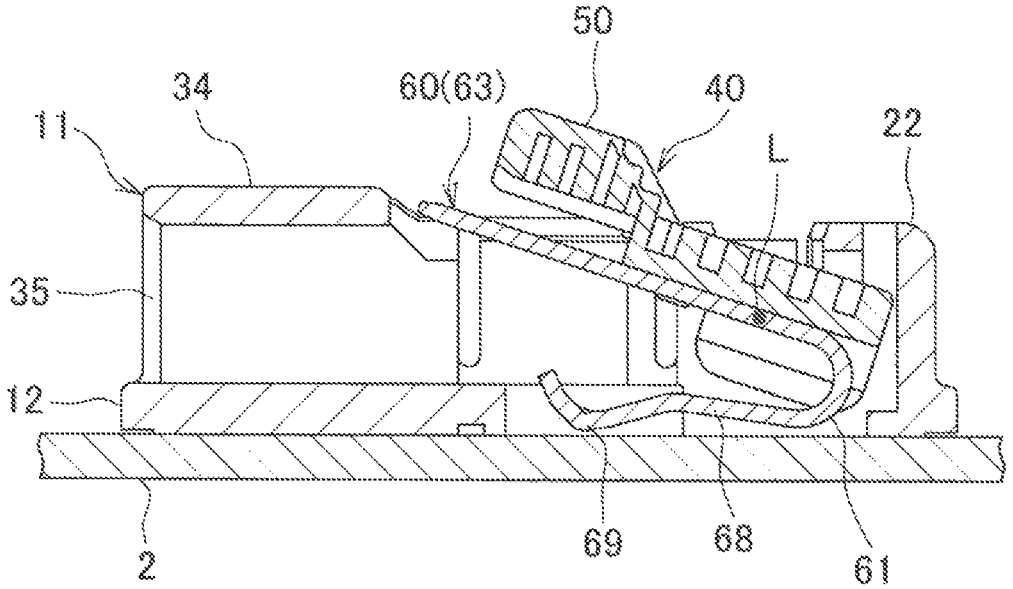
FIG. 12 is a cross sectional view taken along the line XII-XII of FIG. 10.

Then, as shown in FIG. 8, the holding unit 40 and the male terminal 60 are made upright in the up-down direction, and inserted downward into the housing 11 from the above (see FIG. 9). This way, the shaft portions 55 of the holding unit 40 fits into the fitting holes 23 of the first side walls 21, supporting the holding unit 40 rotatably about the shaft portions 55 with respect to the housing 11. It should be noted that, as shown in FIG. 11 and FIG. 12, the rotation axis L of the holding unit 40 is positioned at the center of the shaft portions 55 and extends in the width direction in the housing 11 (more specifically, in a range passing through the bent area 61).

Figure 10:
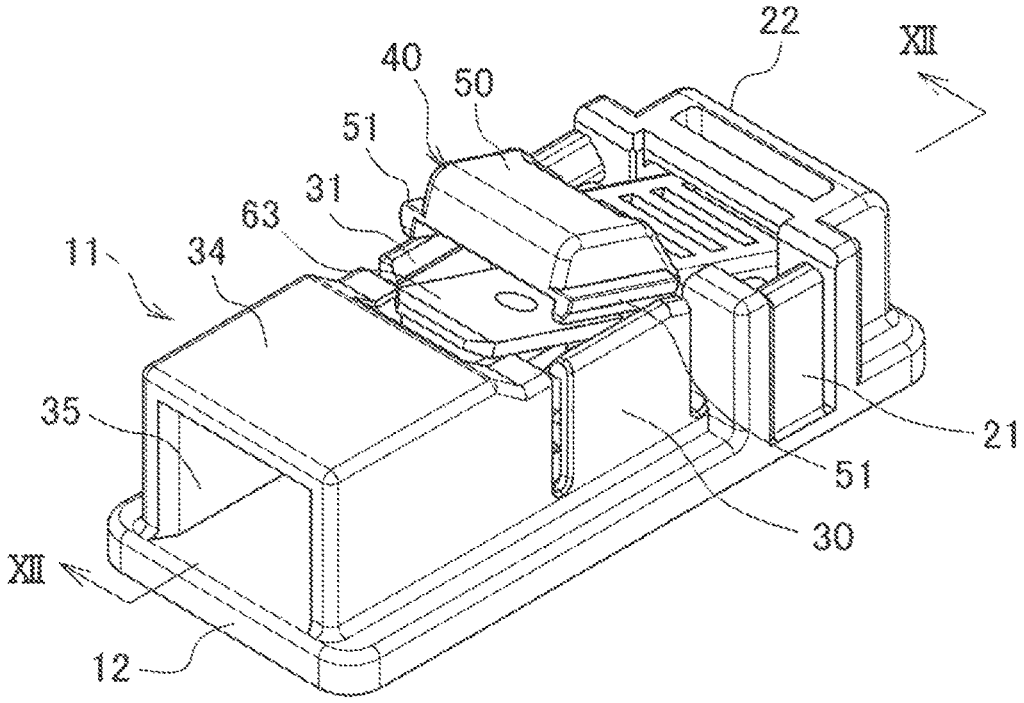
FIG. 10 is a perspective view showing a state in which the holding unit is held in a temporal locking position.

In the state shown in FIG. 9, pressing the cover member 50 of the holding unit 40 towards the center of the housing 11 relative to the length direction rotates the holding unit 40 and the cover member 50 about the shaft portions 55. This way the holding unit 40 and the cover member 50 are supported in the temporal locking position as shown in FIG. 10. In this temporal locking position, the second lock sections 51 of the cover member 50 are locked at the upper ends of the second side walls 30, and the first lock sections 56 of the shaft portions 55 are locked at the third lock sections 25 of the first side walls 21, as shown in FIG. 11.

While the holding unit 40 is supported in the temporal locking position, an adhesive is applied to the back-side recess 14 of the bottom plate 12, and the housing 11 is fixed to the base 1. It should be noted that, while the holding unit 40 is in the temporal locking position, the housing 11 maintains the holding unit 40 in the stationary state, and the male terminal 60 is not elastically deformed and does not contact the conductive film 2 (see FIG. 12).

Figure 13:
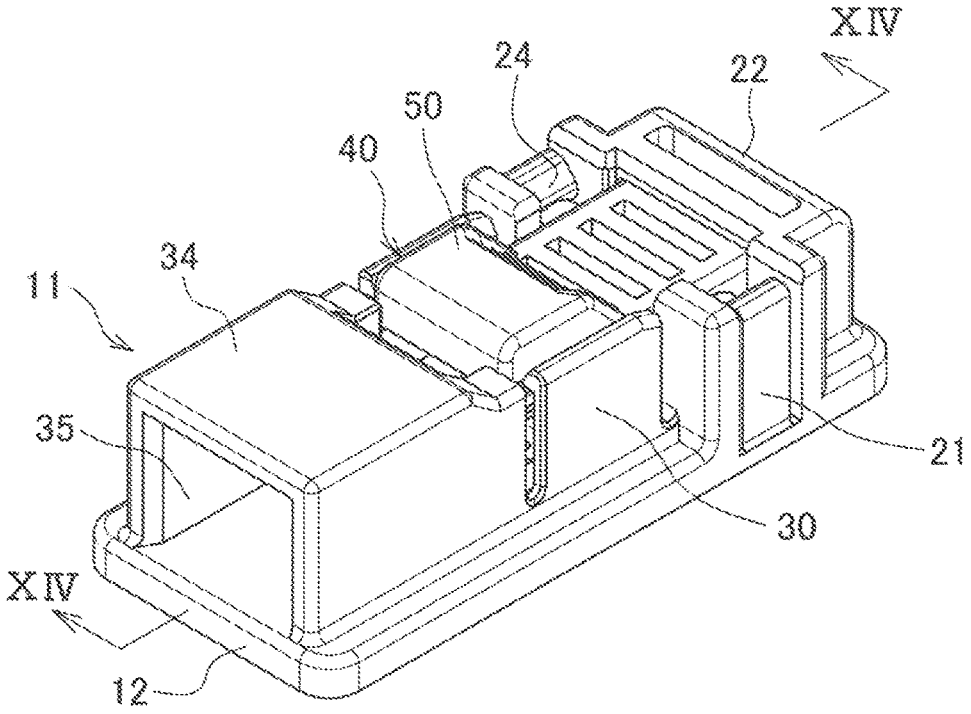
FIG. 13 is a perspective view showing a state in which the holding unit is held in a non-temporal locking position.
Figure 14:
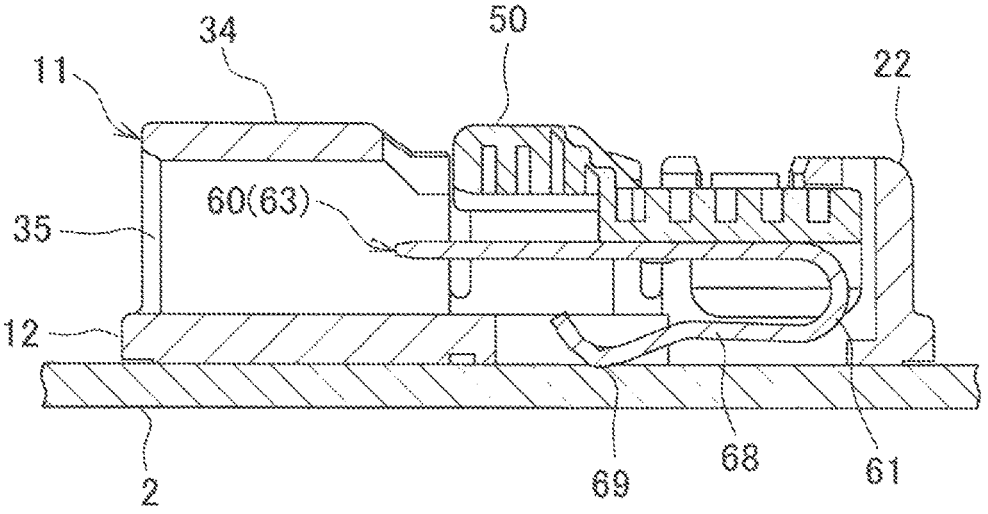
FIG. 14 is a cross sectional view taken along the line XIV-XIV of FIG. 13.

Then, by pressing the cover member 50 of the holding unit 40 towards the bottom plate 12, the second lock sections 51 are unlocked from the upper ends of the second side walls 30 and the first lock sections 56 are unlocked from the third lock sections 25. This way, the holding unit 40 and the cover member 50 are rotated and the holding unit 40 is supported in the non-temporal locking position as shown in FIG. 13. It should be noted that, while the holding unit 40 is in the non-temporal locking position, the housing 11 maintains the holding unit 40 in the stationary state, and the male terminal 60 is elastically deformed and contacts the conductive film 2 to conduct electricity (see FIG. 14). With the male terminal 60 contacts the conductive film 2 and elastically deforms, the holding unit 40 is biased upward; however, the second lock sections 51 of the holding unit 40 is locked to the fourth lock sections 31 of the second side walls 30 to maintain the holding unit 40 in the non-temporal locking position. Further, while the holding unit 40 is in the non-temporal locking position, the cover member 50 extended along the male terminal 60 covers the side of the male terminal 60 opposite to the side facing the base 1.

By inserting the female connector 5 into the accommodation unit 34 of the housing 11 thus fitting the female connector 5 together with the housing 11, during this state, the male terminal 60 contacts the female terminal 6 and conducts electricity. Thus, the female terminal 60 and the conductive film 2 are electrically connected.

[Characteristics of Connector of the Present Embodiment]

The male connector 10 of the present embodiment has the following characteristics.

The male connector 10 of the present embodiment allows the housing 11 to be fixed to the base 1. Therefore, the conductive film 2 formed on the base 1 is electrically connected with the female terminal 6. Further, lead-free connection is possible by adopting means other than soldering (e.g., adhesive in the present embodiment) for fixing the housing 11 to the base 1. The male terminal 60 is not in contact with the conductive film 2 while it is in the temporal locking position, the male connector 10 will be free of the reaction force caused by the male terminal 60 contacting the conductive film 2 while being elastically deformed. Therefore, a stress will not act on the male connector 10, when the housing 11 is fixed to the base 1 by an adhesive, while the holding unit 40 is in the temporal locking position. Further, the male terminal contacts the female terminal 6, thereby electrically connecting the conductive film 2 with the female terminal 6, through a relatively simple work of fitting the housing 11 together with the female connector 5, while displacing the holding unit 40 from the temporal locking position to the non-temporal locking position.

In the male connector 10 of the present embodiment, the holding unit 40 is supported rotatably with respect to the housing 11. This ways, the holding unit 40 is easily displaced from the temporal locking position to the non-temporal locking position simply by rotation.

In the male connector 10 of the present embodiment, the housing 11 has a pair of first side walls 21 respectively having fitting holes 23 on their inner side surfaces, and that the holding unit 40 has a pair of shaft portions 55 which fit in the fitting holes 23. This realizes a simple structure for supporting the holding unit 40 rotatably with respect to the housing 11.

In the male connector 10 of the present embodiment, the first lock sections 56 of the holding unit 40 are locked to the third lock sections 25 of the housing 11, while the holding unit 40 is in the temporal locking position. This realizes a simple structure whereby the holding unit 40 is maintained in a stationary state in the temporal locking position.

In the male connector 10 of the present embodiment, the direction of the openings 35 which is the direction of inserting the female connector 5 into the accommodation unit 34 is perpendicular to the rotation axis line L of the holding unit 40, and is parallel to the mounting surface of the housing 11 to the base 1. This facilitates a user to grasp the insertion direction of the female connector 5 to the housing 11, thereby improving the working efficiency.

In the male connector 10 of the present embodiment, the male terminal 60 has a press-fit portion which is press-fit into the holding unit 40, and the male terminal 60 is be held by holding unit 40 at the press-fit portion. This facilitates fixing of the male terminal 60 to the holding unit 40.

In the male connector 10 of the present embodiment, the holding unit 40 includes a cover member 50 extended along the male terminal 60, which covers a side of the male terminal 60 opposite to the side facing the base 1, while the holding unit 40 is in the non-temporal locking position. This enables prevention of the male terminal 60 from contacting an exterior member, while the holding unit 40 is in the non-temporal locking position. Further, the above structure keeps the male terminal 60 away from dusts.

In the male connector 10 of the present embodiment, the male terminal 60 includes: a bent area 61 bent in a substantially U-shape; a first area 62 extended from one end of the bent area 61, which has a first contact point 63; and second areas 68 each extended from the other end of the bent area 61, which have second contact points 69, respectively. This makes the structure of the male terminal 60 simple.

In the male connector 10 of the present embodiment, the male terminal 60 is provided with a plurality of the second areas 68 whose respective positions with respect to the first area 62 change independently of the others by elastic deformation of the male terminal 60. This restrains a decrease in the contact area when the surface of the conductive film 2 is not even, and therefore improves the contact reliability of the male terminal 60 with respect to the conductive film 2.

With the male connector 10 of the present embodiment, it is possible to apply the connector of the present invention to cases where the base 1 is glass for use in a vehicle, for example.

Next, the following describes modifications of the above described embodiment.

Figure 16:
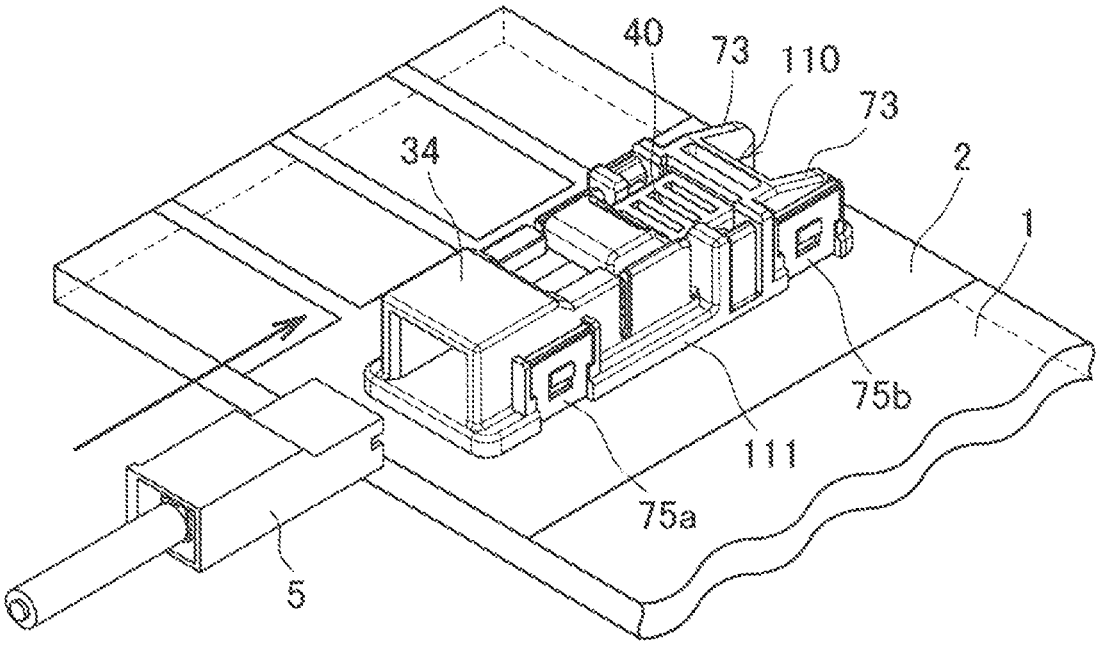
FIG. 16 is a perspective view of a modification, showing a state before a female connector is inserted into a male connector.
Figure 17:
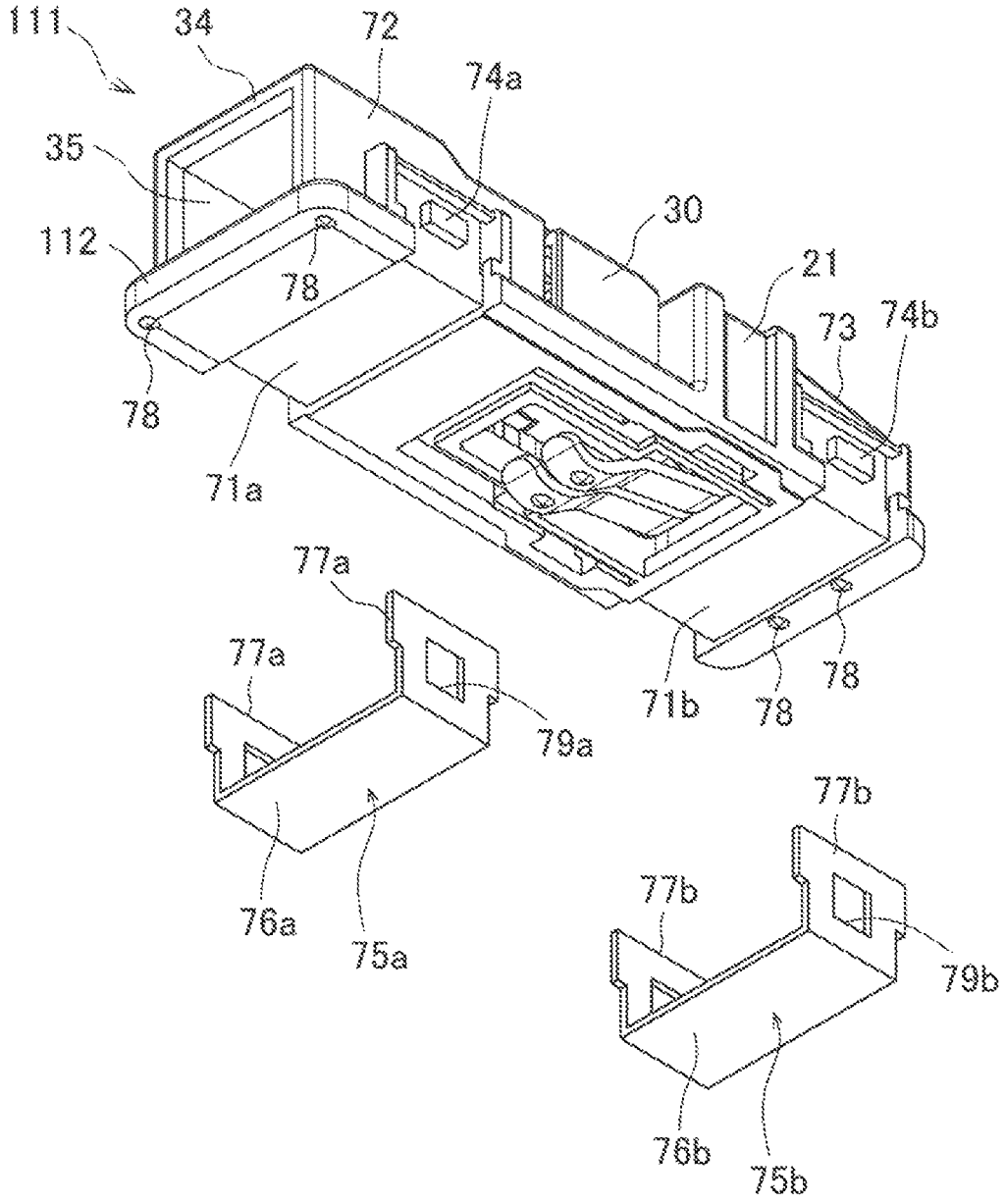
FIG. 17 is a bottom perspective view of the modification, showing a state in which the male connector and a reinforcement member are separated.

In the above embodiment, the back-side recess 14 for applying thereto an adhesive is provided to the back surface of the housing 11, so that the housing 11 is fixable to the base 1. However, the present invention is not limited to this, and as shown in FIG. 16, at least one metal-made reinforcement member (in the present modification, two reinforcement members 75*a* and 75*b*) may be attached to a housing 111 for fixing the housing 111 to the base 1 using an adhesive. In the present modification, the housing 111 is provided with two grooves 71*a* and 71*b* to which the two reinforcement members 75*a* and 75*b* are fitted, the grooves being formed in positions apart from each other relative to the length direction of the housing 111 so as to sandwich therebetween two pairs of side walls 21 and 30, as shown in FIG. 17. The reinforcement members 75*a* and 75*b* strengthen the housing 111 and make the housing 111 hardly damageable. Further, since the reinforcement members 75*a* and 75*b* are fitted into the grooves 71*a* and 71*b*, the positions of reinforcement members 75*a* and 75*b* are hardly changed.

The groove 71*a* which is closer to the second side walls 30 than the groove 71*b* is formed throughout the side faces 72 on both sides of the accommodation unit 34 to the back surface of a bottom plate 112. On the bottom surfaces of the groove 71*a* corresponding to the side faces 72, there is provided a lock protrusion 74*a* protruding outwardly. The bottom surface of the groove 71*a* corresponding to the back surface of the bottom plate 112 extends rectilinearly in the width direction perpendicular to the length direction of the bottom plate 112.

The housing 111 is provided with a pair of third side walls 73 which faces each other in the width direction, on a side of the first side walls 21 opposite to the side of the second side walls 30. The pair of third side walls 73 are each extended vertically upward from the edge portion of the length side of the bottom plate 112. The groove 71*b* which is closer to the first side wall 21 than the groove 71*a* is formed throughout the third side walls 73 on both sides to the back surface of a bottom plate 112. On the bottom surfaces of the groove 71*b* corresponding to the third side walls 73, there is provided a lock protrusion 74*b* protruding outwardly. The bottom surface of the groove 71*b* corresponding to the back surface of the bottom plate 112 extends rectilinearly in the width direction of the bottom plate 112.

In two corner portions on the back surface of the bottom plate 112 nearby the groove 71*a*, there are provided two semi-spherically bulged ribs 78. In an area nearby the groove 71*b* on the back surface of the bottom plate 112 on a side of the groove 71*b* opposite to the side of the groove 71*a*, two semi-spherically bulged ribs 78 are provided side by side in the width direction. The height of each of the ribs 78 (more specifically, the height from the plane defining the entrance opening of the groove 71*a*) is preferably greater than the result of subtracting the depth of the grooves 71*a* and 71*b* from the thicknesses of the reinforcement members 75*a* and 75*b*. It should be noted that the ribs 78 do not have to be formed in the present modification.

The reinforcement members 75*a* and 75*b* include rectilinearly extending plate portions 76*a* and 76*b*, and two arm portions 77*a* and 77*b* vertically extending upward from both ends of the plate portions 76*a* and 76*b*, respectively. The two arm portions 77*a* and 77*b* are not limited to those vertically extending with respect to the plate portions 76*a* and 76*b*, as in the present modification. The arm portions 77*a* and 77*b* are provided with lock holes 79*a* and 79*b* which are each in a square shape when viewed from the front. The thicknesses of the reinforcement members 75*a* and 75*b* in the present modification are the same as the grooves 71*a* and 71*b*. It should be noted that the reinforcement members 75*a* and 75*b* may only include the plate portions 76*a* and 76*b*, without the arm portions 77*a* and 77*b*, and may be structured so that the plate portions 76*a* and 76*b* are locked on the bottom surface of the housing 111.

Figure 18:
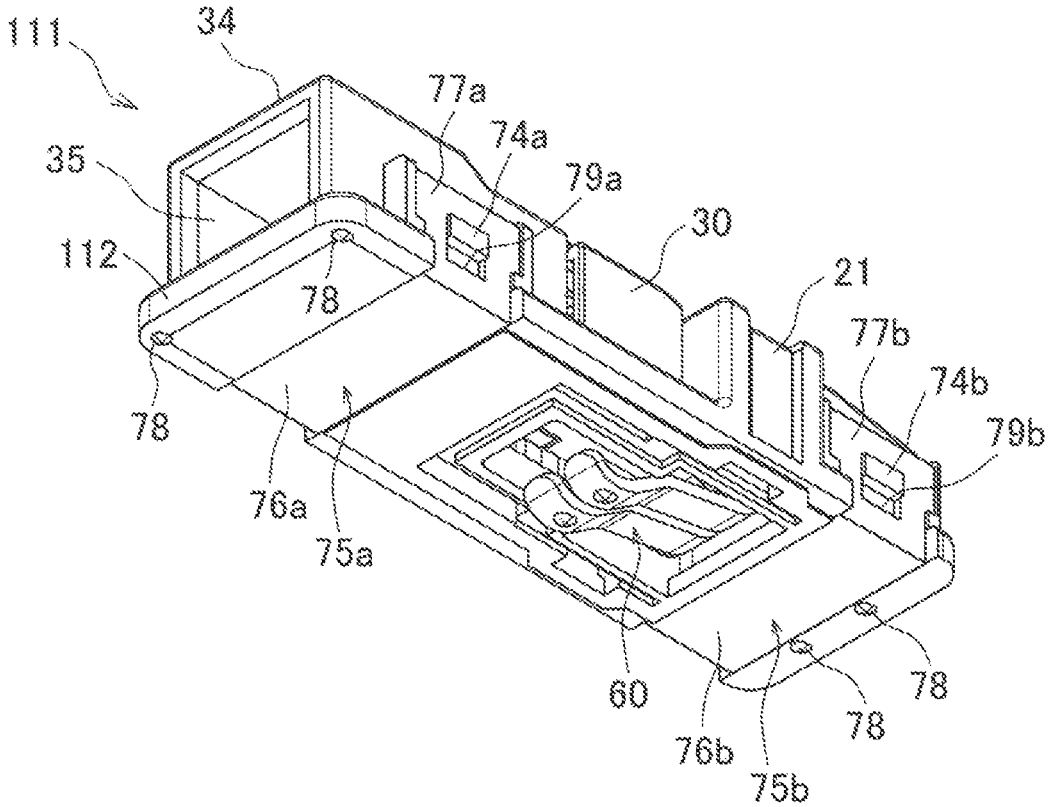
FIG. 18 is a bottom perspective view of the modification, showing a state in which the reinforcement member is attached to the male connector.

When the two reinforcement members 75*a* and 75*b* are attached to the housing 111 as shown in FIG. 18, the lock protrusions 74*a* and 74*b* on the housing 111 are locked to the lock holes 79*a* and 79*b* of the reinforcement members 75*a* and 75*b*. Further, the plate portions 76*a* and 76*b* of the reinforcement members 75*a* and 75*b* structures the back surface of the housing 111, along with the bottom plate 112.

Figure 19:
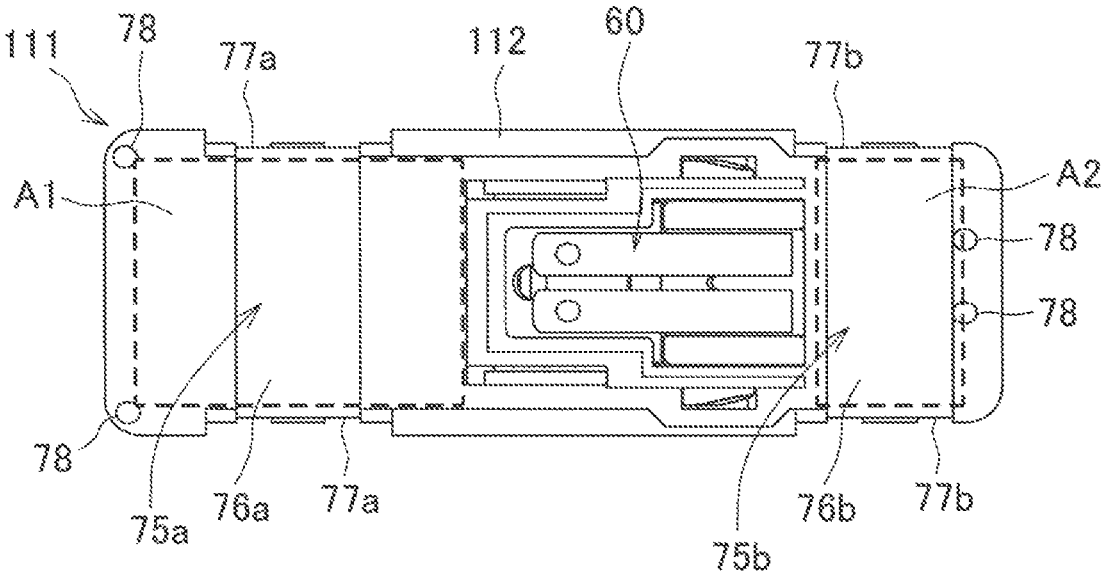
FIG. 19 is a bottom view of the modification, showing a back surface of the male connector.

To fix the housing 111 to the base 1, adhesive is applied to rectangular areas A1 and A2 including the plate portions 76*a* and 76*b* of the reinforcement members 75*a* and 75*b*, as shown in FIG. 19. This way, the housing 111 is fixed to the base 1 through the adhesive. The plate portions 76*a* and 76*b* of the reinforcement members 75*a* and 75*b* faces the conductive film 2, while the housing 111 is fixed to the base 1. That is, two metal members are combined with the adhesive, hence more firmly fixing the housing 111 to the base 1, as compared with a case of adhering a metal member with a resin member. Further, since there are wider variety of adhesives usable, as compared to the case of adhering a metal member with a resin member, it is possible to use a cost-efficient adhesive that provides a strong adhesion. Particularly in the present modification, the two reinforcement members 75*a* and 75*b* are arranged in positions sandwiching the male terminal 60 while the holding unit 40 is in the non-temporal locking position, as should be understood from FIG. 19. This fixes housing 111 more reliably to the base 1.

It should be noted that, while the housing 111 is fixed to the base 1, the conductive film 2 facing the plate portions 76*a* and 76*b* with a space therebetween by the four ribs 78, and the adhesive is filled in the space between these members. As described in the present modification, the four ribs 78 reliably provides a space between the metal conductive film 2 and the metal reinforcement members 75*a* and 75*b*. Therefore, the amount of adhesive between the conductive film 2 and the reinforcement members 75*a* and 75*b* is reliably made a predetermined amount or more, which fixes the housing 111 further firmly to the base 1.

The following describes other modifications. In the above-described embodiment, the holding unit 40 is supported rotatably with respect to the housing 11; however, for example, the holding unit 40 may be supported slideably in parallel to the housing 11.

The first lock sections 56 and the second lock sections 51 of the above-described embodiment are separate structures; however, the first lock sections may also serve as the second lock sections. Similarly, the third lock sections 25 and the fourth lock sections 31 of the embodiment are separate structures; however, the third lock sections may also serve as the fourth lock sections. This makes the structures of the housing 11 and the holding unit 40 simple.

In the above-described embodiment, the housing 11 is fixed to the base 1 by using an adhesive; however, the housing 11 may be fixed to the base 1 by using means other than the adhesive, such as screwing, welding, soldering, and the like.

In the above-described embodiment, the male connector 10 holds the male terminal 60, and the female connector 5 holds the female terminal 6; however, the male connector 10 may hold the female terminal 6 and the female connector 5 may hold the male terminal 60.

In the above-described embodiment, the male terminal 60 is press-fit to fix to the holding unit 40; however, the male terminal 60 may be held by the holding unit 40 by using means other than the press-fitting, such as adhesive or engagement.

In the above-described embodiment, there are provided two second areas 68; however, the number of the second area 68 may be one or three or more.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A connector for use in electrically connecting a conductive film formed on abase to a counterpart terminal held by a counterpart connector, comprising:

a housing fixed on the base;

a holding unit displaceably supported with respect to the housing; and an elastically deformable terminal held by the holding unit, wherein the holding unit has a first lock section and a second lock section, the housing has a third lock section and a fourth lock section, and the holding unit displaces with respect to the housing so as to selectively take a temporal locking position where the first lock section and the third lock section are engaged with each other, and a non-temporal locking position in which the second lock section and the fourth lock section are engaged with each other, the housing is able to maintain the holding unit in a stationary state with the terminal undeformed and apart from the conductive film, while the holding unit is in the temporal locking position with the housing fixed to the base, the housing is able to maintain the holding unit in a stationary state with the terminal elastically deformed and contacting the conductive film, while the holding unit is in the non-temporal locking position with the housing fixed to the base, and the terminal is able to contact the counterpart terminal, by having the housing fit together with the counterpart connector, while the holding unit is in the non-temporal locking position.

2. The connector according to claim 1, wherein the holding unit is supported rotatably with respect to the housing.

3. The connector according to claim 2, wherein the housing has a pair of side walls respectively having fitting holes on their inner side surfaces, and the holding unit has a pair of shaft portions which fit in the fitting holes, respectively.

4. The connector according to claim 3, wherein the housing has, as the third lock section, recesses on the circumferences of the fitting holes, which are sunk radially outward of the fitting holes;

the holding unit has, as the first lock section, protrusions protruding from the outer circumferential surfaces of the shaft portions, in a radially outward direction of the shaft portions; and each of the protrusions of the holding unit is locked in corresponding one of the recesses of the housing, while the holding unit is in the temporal locking position.

5. The connector according to claim 2, wherein the housing has an accommodation unit having an opening, in which the counterpart connector is inserted, and the direction of the opening which is the direction of inserting the counterpart connector into the accommodation unit is perpendicular to a rotation axis of the holding unit and parallel to a mounting surface of the housing with respect to the base.

6. The connector according to claim 1, further comprising: one or more metal-made reinforcement members which are attached to the housing; and each of the one or more reinforcement members has a portion facing the conductive film, while the housing is fixed to the base.

7. The connector according to claim 6, wherein two of the reinforcement members are disposed in positions to sandwich the terminal, while the holding unit is in the non-temporal locking position.

8. The connector according to claim 1, wherein the terminal has a press-fit portion which is press-fit into the holding unit, and the terminal is held by the holding unit at the press-fit portion.

9. The connector according to claim 1, wherein the holding unit includes a cover member extended along the terminal, which covers a side of the terminal opposite to the side facing the base, while the holding unit is in the non-temporal locking position.

10. The connector according to claim 1, wherein the terminal includes:

a bent area bent in a substantially U-shape;

a first area extended from one end of the bent area, which has a first contact point that contacts the counterpart terminal; and one or more second areas each extended from the other end of the bent area so that its position with respect to the first area changes by elastic deformation of the terminal, the one or more second areas each having a second contact point that contacts the conductive film.

11. The connector according to claim 10, wherein the terminal is provided with a plurality of the second areas whose respective positions with respect to the first area change independently of the one another by elastic deformation of the terminal.

12. The connector according to claim 1, wherein the terminal, through elastic deformation, contacts the conductive film formed on the base made of glass, while the holding unit is in the non-temporal locking position.

* * * * *